US011234306B2

(12) United States Patent
Yang et al.

(10) Patent No.: US 11,234,306 B2
(45) Date of Patent: Jan. 25, 2022

(54) STABILIZING SYSTEM AND CURRENT CONTROLLER THEREOF

(71) Applicant: XIAMEN LEEDARSON LIGHTING CO.,LTD, Fujian (CN)

(72) Inventors: Shihhsueh Yang, Fujian (CN); Chunchieh Kuo, Fujian (CN); Yihsiung Lin, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 16/998,884

(22) Filed: Aug. 20, 2020

(65) Prior Publication Data

US 2021/0092816 A1 Mar. 25, 2021

(30) Foreign Application Priority Data

Sep. 25, 2019 (TW) ..... 108134652

(51) Int. Cl.

| | |
|---|---|
| ***H05B 45/37*** | (2020.01) |
| ***H05B 45/36*** | (2020.01) |
| ***H05B 45/345*** | (2020.01) |
| ***H05B 45/14*** | (2020.01) |

(52) U.S. Cl.

CPC ..... *H05B 45/36* (2020.01); *H05B 45/14* (2020.01); *H05B 45/345* (2020.01)

(58) Field of Classification Search

CPC ..... H05B 45/14; H05B 45/20; H05B 45/31; H05B 45/37; H05B 45/375; H05B 45/382; H05B 45/385

See application file for complete search history.

(56) References Cited

U.S. PATENT DOCUMENTS

| | | | | |
|---|---|---|---|---|
| 9,113,521 | B2 * | 8/2015 | Gredler | H05B 47/10 |
| 2011/0140620 | A1 * | 6/2011 | Lin | H05B 45/3725 315/224 |
| 2016/0219662 | A1 * | 7/2016 | Ho | H05B 45/3725 |
| 2016/0330808 | A1 * | 11/2016 | Brandt | H05B 45/10 |
| 2020/0229278 | A1 * | 7/2020 | Gommans | H05B 45/385 |

* cited by examiner

*Primary Examiner* — Tung X Le
(74) *Attorney, Agent, or Firm* — Chun-Ming Shih; Lanway IPR Services

(57) ABSTRACT

A stabilizing system includes an AC power supply, a TRIAC dimmer circuit, a load conversion circuit and a current controller. The TRIAC dimmer circuit dynamically generates a drive power. The load conversion circuit filters noises off the drive power and drives an external LED unit using the filtered drive power. The current controller detects an activating phase of the AC power supply's AC voltage from the drive power. The current controller keeps a sum of a buffer current of the current controller and a load current of the load conversion circuit to approximate a predetermined critical current value and to exceed an operating current of the TRIAC dimmer circuit in response to the detected activating phase of the AC voltage.

20 Claims, 3 Drawing Sheets

STABILIZING SYSTEM AND CURRENT CONTROLLER THEREOF

FIELD

The present invention relates to a stabilizing system and a current controller thereof, and more particularly, to a stabilizing system for a conditional triode for alternating current (TRAIC) controllable dimmer and a current controller designed for said stabilizing system.

BACKGROUND

A conditional triode for alternating current (TRIAC) dimmer may include a variable resistor, a constant resistor, a capacitor, a diode for alternating current (DIAC) switch, and a TRIAC element. And the conventional TRIAC dimmer may further include a RC circuit that consists of the variable resistor, the constant resistor and the capacitor. After the conventional TRIAC dimmer is powered up, a current flow through the variable resistor, the constant resistor and then the capacitor for charging the capacitor. Moreover, when the capacitor is charged up to the DIAC switch's trigger voltage level, the DIAC switch is conducted, and the TRIAC element is in turn conducted. Such that the TRIAC element starts charging a lamp that is connected to said TRAIC element.

As the variable resistor's resistance raises, the current that flows through the capacitor decreases, the capacitor's cross voltage will reach the DIAC switch's trigger voltage level slower, and the TRIAC element in turn conducts slower. Such that part of a sinusoidal wave of an input AC voltage will not charge the capacitor. In turn, the lamp will receive lower energy and reduce its luminance. In summary, the higher the variable resistor's resistance is, the lower the lamp's luminance is.

For a light emitting diode (LED) lamp that applies a TRIAC dimmer, the compatibility between the LED lamp and the TRIAC dimmer becomes a significant issue. Specifically, the conventional TRIAC dimmer is merely designed to process power of hundreds of watts for incandescent bulbs. However, for LED bulbs that consume merely less than twenty watts of power, such LED bulbs may not be capable of stably cooperating with the switches that are specifically designed for large scale of power. Such that the LED bulbs may deteriorate its interaction with the conventional TRIAC dimmer. And in turn, such deteriorated interaction may introduce flickers in the LED lamp's illumination.

SUMMARY

The present disclosure aims at disclosing a stabilizing system for a controllable dimmer. The stabilizing system includes an alternating current (AC) power supply, a triode for alternating current (TRIAC) dimmer circuit, a load conversion circuit and a current controller. First, the AC power supply provides an AC voltage. Second, the TRIAC dimmer circuit is electrically coupled to the AC power supply. Also, the TRIAC dimmer circuit dynamically generates a drive power. Third, the load conversion circuit is electrically coupled to the TRIAC dimmer circuit. In addition, the load conversion circuit filters noises off the drive power and drives an external light emitting diode (LED) unit using the filtered drive power. Fourth, the current controller is electrically coupled to the AC power supply, the TRIAC dimmer circuit and the load conversion circuit. Moreover, the current controller detects an activating phase of the AC voltage from the drive power. Specifically, during activating phase, the TRAIC dimmer circuit receives power from the AC power supply. Besides, the current controller keeps a sum of a buffer current of the current controller and a load current of the load conversion circuit to approximate a predetermined critical current value and to exceed an operating current of the TRIAC dimmer circuit in response to the detected activating phase of the AC voltage. Last, the TRIAC dimmer circuit further dynamically generates the drive power using the AC voltage and the TRIAC dimmer circuit's operating current in response to the activating phase of the AC voltage.

In one example, the stabilizing system also includes a rectifier that is electrically coupled to the TRAIC dimmer circuit. Also, the rectifier rectifies the drive power.

In one example, the rectifier rectifies the drive power via half-bridge rectification.

In one example, the rectifier rectifies the drive power via full-bridge rectification.

In one example, the TRAIC dimmer circuit includes a variable resistor, a constant resistor, a diode for alternating current (DIAC) switch, a capacitor and a TRIAC element. The variable resistor's first terminal is electrically coupled to the AC power supply. The constant resistor's first terminal is electrically coupled to a second terminal of the variable resistor. The DIAC switch's first terminal is electrically coupled to a second terminal of the constant resistor. The capacitor's first terminal is electrically coupled to a second terminal of the DIAC switch. Also, the capacitor's second terminal is electrically coupled to the load conversion circuit. The TRIAC element's trigger terminal is electrically coupled to a switch terminal of the DIAC switch. In addition, the TRIAC element's input terminal is electrically coupled to the AC power supply and the first terminal of the variable resistor. Besides, the TRIAC element's output terminal is electrically coupled to the load conversion circuit and a second terminal of the capacitor.

In one example, the DIAC switch triggers the TRIAC element when a cross voltage of the capacitor exceeds an activating threshold of the DIAC switch. Also, the TRIAC element powers up the load conversion circuit while being triggered by the DIAC switch.

In one example, the TRAIC dimmer circuit is implemented using a forward phase controller.

In one example, the TRAIC dimmer circuit is implemented using a reverse phase controller.

In one example, the current controller includes a buffer current source, a buffer switch, a test resistor, a phase detection module and a current compensation module. The buffer current source is electrically coupled to the TRIAC dimmer circuit and the load conversion circuit. The buffer switch's drain terminal is electrically coupled to the buffer current source. The test resistor's first terminal electrically coupled to the load conversion circuit. Also, the test resistor's second terminal is electrically coupled to the AC power supply. The phase detection module's first terminal is electrically coupled to the TRAIC dimmer circuit. In addition, the phase detection module's second terminal is electrically coupled to a control terminal of the buffer switch. The current compensation module's sample terminal is electrically coupled to the load conversion circuit and the first terminal of the test resistor. Besides, the current compensation module's compensation terminal is electrically coupled to a control terminal of the buffer current source.

In one example, the phase detection module detects the activating phase of the AC voltage. Also, the phase detection module activates the buffer switch in response to the activating phase of the AC voltage.

In one example, the current compensation module receives the load current from the load conversion circuit. In addition, the current compensation module generates a compensation control signal to the control terminal of the buffer current source. In this way, the compensation control signal activates or deactivates the buffer current source in a manner that keeps the sum of the buffer current and the load current to approximate the predetermined critical current value and to exceed the operating current.

In one example, the current compensation module renders the compensation control signal to deactivate the buffer current source when the load current is larger than the predetermined critical current value.

In one example, the current compensation module includes a voltage follower, an error amplifier and a voltage divider. The voltage follower's first input terminal is electrically coupled to an output terminal of the voltage follower. The error amplifier's first input terminal is electrically coupled to the output terminal of the voltage follower. Also, the error amplifier's second input terminal is electrically coupled to the load conversion circuit and the first terminal of the test resistor. Besides, the error amplifier's output terminal is electrically coupled to the control terminal of the buffer current source. The voltage divider's voltage dividing terminal is electrically coupled to a second input terminal of the voltage follower. Moreover, the voltage divider's ground terminal is electrically coupled to ground. In addition, the voltage divider's power terminal is electrically coupled to a direct-current (DC) voltage source.

In one example, the current compensation module also includes a capacitor. The capacitor's first terminal is electrically coupled to the first input terminal of the error amplifier. And the capacitor's second terminal is electrically coupled to the ground terminal of the voltage divider.

In one example, the voltage divider generates a constant divided voltage that corresponds to the predetermined critical current value.

In one example, the stabilizing system also includes a voltage divider. The voltage divider's first terminal is electrically coupled to the TRIAC dimmer circuit and the load conversion circuit. Also, the voltage divider's second terminal is electrically coupled to the AC power supply and the second terminal of the test resistor. In addition, the voltage divider's voltage dividing terminal is electrically coupled to the first terminal of the phase detection module.

The present disclosure also discloses a current controller for a controllable dimmer. The current controller includes a buffer current source, a buffer switch, a test resistor, a phase detection module and a current compensation module. The buffer current source generates a buffer current in response to an external operating current of an TRIAC dimmer circuit. The buffer switch's drain terminal is electrically coupled to the buffer current source. The test resistor's first terminal receives a load current from an external load conversion circuit. The phase detection module is electrically coupled to a control terminal of the buffer switch. Also, the phase detection module detects an activating phase of an external AC voltage that synchronizes with the TRIAC dimmer circuit. In addition, the phase detection module activates the buffer switch in response to the activating phase of the AC voltage. The current compensation module's sample terminal is electrically coupled to the first terminal of the test resistor. Besides, the current compensation module's compensation terminal is electrically coupled to a control terminal of the buffer current source. And the current compensation module receives the load current. Moreover, the current compensation module generates a compensation control signal to the control terminal the buffer current source. Such that the compensation control signal activates or deactivates the buffer current source in a manner that keeps the sum of the buffer current and the load current to approximate a predetermined critical current value and to exceed the operating current.

In one example, the current compensation module renders the compensation control signal to deactivate the buffer current source when the load current is larger than the predetermined critical current value.

In one example, the current compensation module includes a voltage follower, an error amplifier and a voltage divider. The voltage follower's first input terminal is electrically coupled to an output terminal of the voltage follower. The error amplifier's first input terminal is electrically coupled to the output terminal of the voltage follower. Also, the error amplifier's second input terminal is electrically coupled to the first terminal of the test resistor. Besides, the error amplifier's output terminal is electrically coupled to the control terminal of the buffer current source. The voltage divider's voltage dividing terminal is electrically coupled to a second input terminal of the voltage follower. Second, the voltage divider's ground terminal is electrically coupled to ground. Third, the voltage divider's power terminal is electrically coupled to a DC voltage source.

In one example, the current compensation module also includes a capacitor. The capacitor's first terminal is electrically coupled to the first input terminal of the error amplifier. And the capacitor's second terminal is electrically coupled to the ground terminal of the voltage divider.

In one example, the voltage divider generates a constant divided voltage that corresponds to the predetermined critical current value.

DETAILED DESCRIPTION

As mentioned above, the present disclosure discloses a stabilizing system for a TRAIC controllable dimmer and a current controller designed for said stabilizing system. The stabilizing system aims at neutralizing the compatibility issue between the LED bulbs for small scale of power and the conventional TRAIC dimmer that is designed for large scale of power. And the disclosed current controller acts as the core of fulfilling the stabilizing system's functions.

Figure 1:
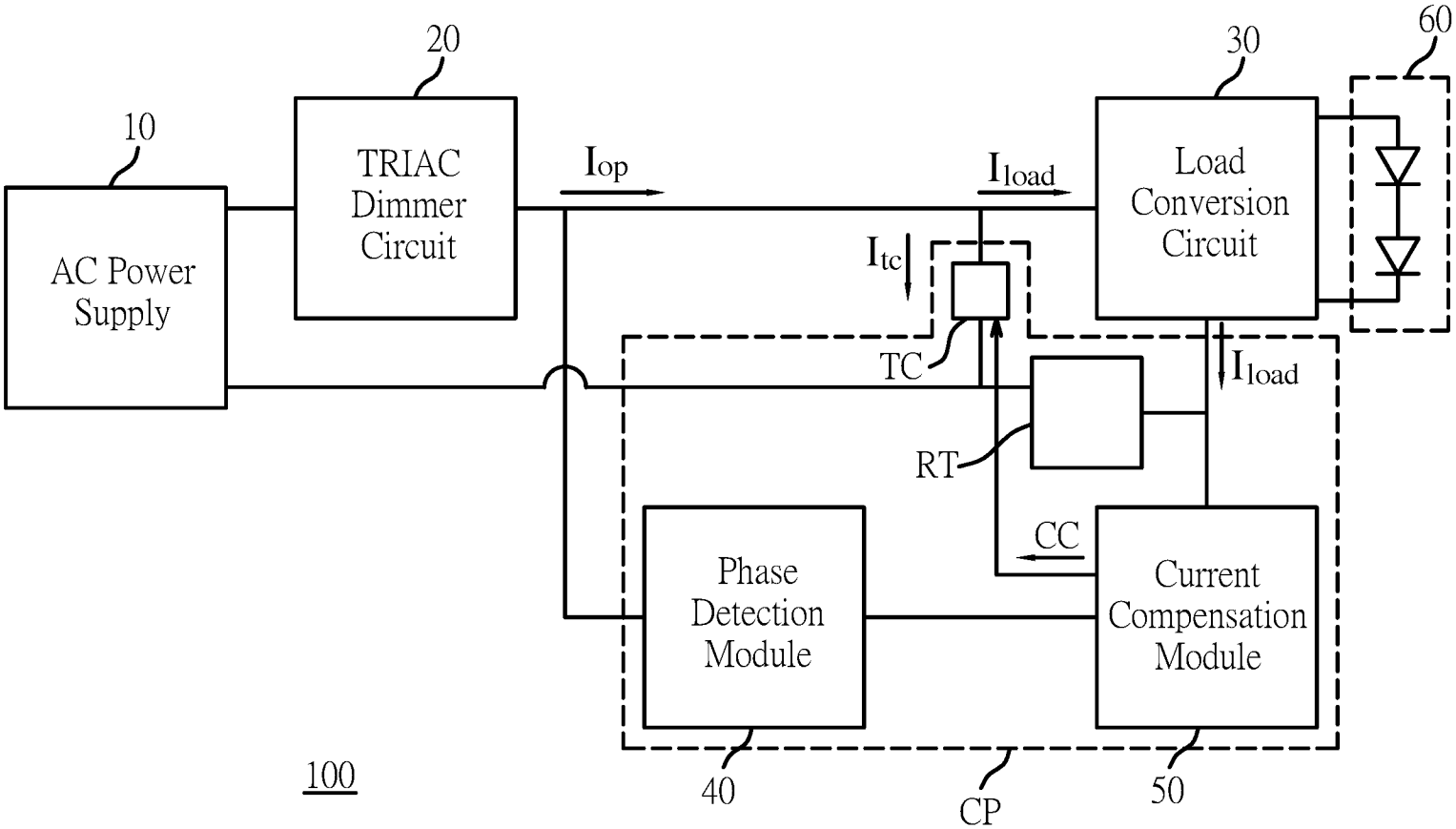
FIG. 1, FIG. 2 and FIG. 3 illustrate schematic diagrams of a stabilizing system for a controllable dimmer according to one embodiment of the present disclosure.
Figure 2:
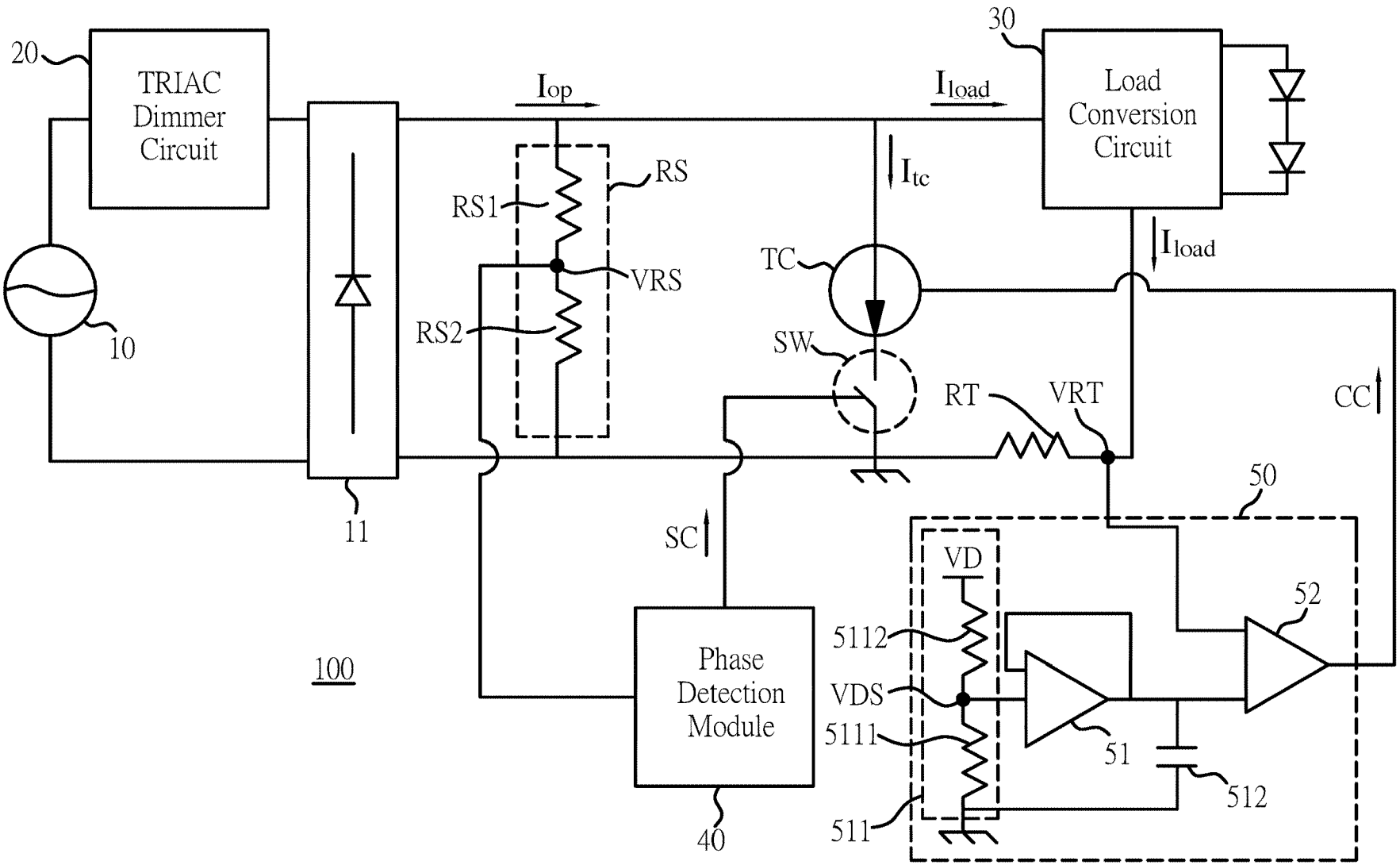
Figure 3:
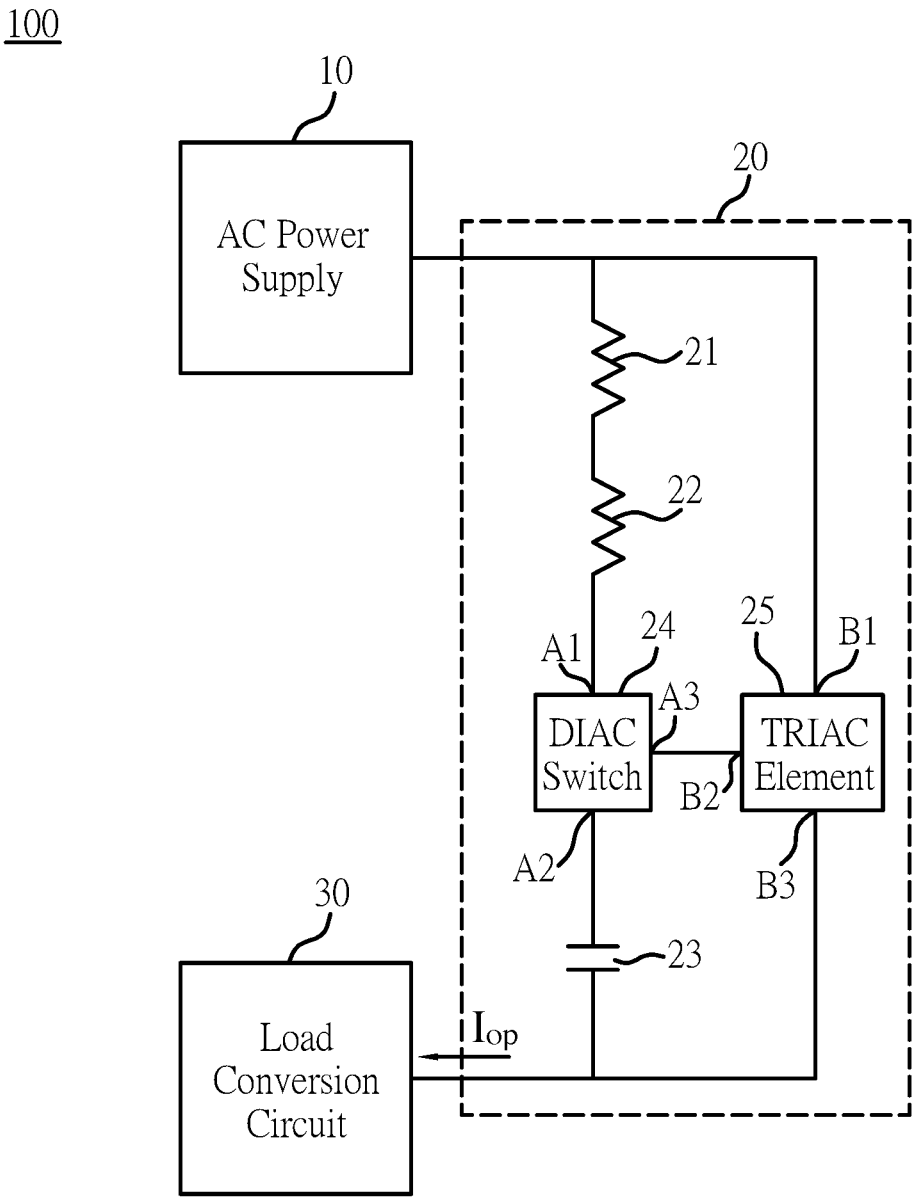

FIG. 1, FIG. 2 and FIG. 3 illustrate schematic diagrams of a stabilizing system 100 for a controllable dimmer according to one embodiment of the present disclosure. The stabilizing system 100 includes an alternating current (AC) power supply 10, a TRIAC dimmer circuit 20, a load conversion circuit 30 and a current controller CP.

The AC power supply 10 provides an AC voltage. In some examples, the stabilizing system 100 also includes a rectifier 11 that is electrically coupled to the TRAIC dimmer circuit 20. In addition, the rectifier 11 rectifies a drive power associated by the AC voltage. In some examples, the rectifier 11 rectifies the drive power via half-bridge rectification or full-bridge rectification. In this way, the AC voltage's negative voltage levels are transformed into positive voltage levels that have same absolute amplitudes in voltage level.

The TRIAC dimmer circuit 20 is electrically coupled to the AC power supply 10. Also, the TRIAC dimmer circuit 20 dynamically generates a drive power, e.g., by filtering, for aiding the load conversion circuit 30 in driving an external illuminating unit 60.

In some examples, the TRAIC dimmer circuit 20 includes a variable resistor 21, a constant resistor 22, a DIAC switch 24, a capacitor 23 and a TRIAC element 25. The variable resistor 21's first terminal is electrically coupled to the AC power supply 10. The constant resistor 22's first terminal is electrically coupled to a second terminal of the variable resistor 21. The DIAC switch 24's first terminal is electrically coupled to a second terminal of the constant resistor 22. The capacitor 23's first terminal is electrically coupled to a second terminal of the DIAC switch 24. Also, the capacitor 23's second terminal is electrically coupled to the load conversion circuit 30. The TRIAC element 25's trigger terminal is electrically coupled to a switch terminal of the DIAC switch 24. In addition, the TRIAC element 25's input terminal is electrically coupled to the AC power supply 10 and the first terminal of the variable resistor 21. Moreover, the TRIAC element 25's output terminal is electrically coupled to the load conversion circuit 30 and a second terminal of the capacitor 23.

The DIAC switch 24 triggers the TRIAC element 25 when a cross voltage of the capacitor 23 exceeds an activating threshold of the DIAC switch 24. Additionally, the TRIAC element 25 powers up the load conversion circuit 30 while being triggered by the DIAC switch 24.

As the variable resistor 21's resistance increases, a current flowing through the capacitor 23 decreases. Such that the capacitor 23's cross voltage reaches the DIAC switch 24's trigger voltage in a slower manner. In turn, the TRIAC element 25 is corresponding conducted in a slower manner. As a result, the AC voltage from the AC power supply 10 will not be fully used in each of its duration (i.e., has some phase loss). Moreover, the drive power relayed to the load conversion circuit 30 decreases. And the illuminating unit 60's luminance decreases in response. In this way, the illuminating unit 60 can be substantially prevented from undesired power consumption.

In some examples, the TRAIC dimmer circuit 25 is implemented using a forward phase controller or a reverse phase controller.

The load conversion circuit 30 is electrically coupled to the TRIAC dimmer circuit 20. In addition, the load conversion circuit 30 filters noises off the drive power and drives the external LED unit 60 using the filtered drive power.

The current controller CP is electrically coupled to the AC power supply 10, the TRIAC dimmer circuit 20 and the load conversion circuit 30. Besides, the current controller CP detects an activating phase of the AC voltage from the drive power. Specifically, during the activating phase, the TRAIC dimmer circuit 20 receives power from the AC power supply 10. Moreover, the current controller CP keeps a sum of a buffer current Itc of the current controller CP and a load current load of the load conversion circuit 30 to (1) approximate a predetermined critical current value and to (2) exceed an operating current loop of the TRIAC dimmer circuit 20 in response to the detected activating phase of the AC voltage. Additionally, the TRIAC dimmer circuit 20 dynamically generates the drive power using the AC voltage and the TRIAC dimmer circuit 20's operating current loop in response to the activating phase of the AC voltage.

In some examples, the current controller CP includes a buffer current source TC, a buffer switch SW, a test resistor RT, a phase detection module 40 and a current compensation module 50. Also, the current controller CP can be exemplarily implemented using a programmable processor, such as at least one or a combination of a microprocessor, a digital signal processor (DSP), a programmable controller, an application specific integrated circuit (ASIC), and a radio-frequency system-on-chip (RF SoC) system. Besides, the current controller CP may equip with a storage unit for storing parameters or failure records. The storage unit can be exemplarily implemented using an electrically-erasable programmable read-only memory (EEPROM).

The buffer current source TC is electrically coupled to the TRIAC dimmer circuit 20 and the load conversion circuit 30. The buffer switch SW's drain terminal is electrically coupled to the buffer current source TC for conducting a buffer current Itc or not. The test resistor RT's first terminal is electrically coupled to the load conversion circuit 30. Also, the test resistor RT's second terminal is electrically coupled to the AC power supply 10. The phase detection module 50's first terminal is electrically coupled to the TRAIC dimmer circuit 20. In addition, the phase detection module 50's second terminal is electrically coupled to a control terminal of the buffer switch SW. The current compensation module 50's sample terminal is electrically coupled to the load conversion circuit 30 and the first terminal of the test resistor RT. Moreover, the current compensation module 50's compensation terminal is electrically coupled to a control terminal of the buffer current source TC.

The phase detection module 40 detects the activating phase of the AC voltage. Therefore, the phase detection module 40 is capable of controlling the current compensation module 50's output period to limit its current consumption to a duration during which the TRIAC dimmer circuit 20 receives a current from the AC power supply 10. For such purpose, the phase detection module 40 activates the buffer switch SW in response to the activating phase of the AC voltage.

The current compensation module 50 receives the load current load from the load conversion circuit 30. Moreover, the current compensation module 50 generates a compensation control signal CC to the control terminal of the buffer current source TC. Such that the current compensation module 50 activates or deactivates the buffer current source TC in a manner that keeps the sum of the buffer current Itc and the load current load to approximate the predetermined critical current value and to exceed the operating current loop.

In some examples, the current compensation module 50 also render the compensation control signal CC to deactivate the buffer current source TC when the load current load is larger than the predetermined critical current value. That is, when the current compensation module 50 confirms that the sum of the buffer current Itc and the load current load is sufficient to activate the TRIAC element 25, the current compensation module 50 switches off the buffer current source TC's output current for efficient current/power consumption of both the AC power supply 10 and the TRIAC dimmer circuit 20.

In some examples, the current compensation module 50 includes a voltage follower 51, an error amplifier 52, and a voltage divider 511. The voltage follower 51's first input terminal is electrically coupled to its output terminal. The error amplifier 52's first input terminal is electrically coupled to the output terminal of the voltage follower 51. Also, the error amplifier 52's second input terminal is electrically coupled to the load conversion circuit 30 and the first terminal of the test resistor RT. In addition, the error amplifier 52's output terminal is electrically coupled to the control terminal of the buffer current source TC. The voltage divider 511's voltage dividing terminal is electrically coupled to a second input terminal of the voltage follower 51. In addition, the voltage divider 511's ground terminal is electrically coupled to ground. And the voltage divider 511's power terminal is electrically coupled to a direct-current (DC) voltage source VD. Specifically, in some examples, the voltage divider 511 includes two resistors 5111 and 5112 connected in series for generating a divided constant voltage VDS based on the DC voltage source VD. And the voltage divider 511's voltage dividing terminal is located at the intersection of the resistors 5111 and 5112 for relaying the divided voltage VDS to the voltage follower 51's second input terminal. It is noted that the divided voltage VDS corresponds to the predetermined critical value that a sum of the currents load and Itc should not exceed.

In some examples, the current compensation module 50 further includes a capacitor 512. The capacitor 512's first terminal is electrically coupled to the first input terminal of the error amplifier 52. Furthermore, the capacitor 512's second terminal is electrically coupled to the ground terminal of the voltage divider 511. Specifically, the combination of the capacitor 512, the error amplifier 52 and the voltage divider 511 forms a stable voltage source that has a high input impedance and a low output impedance. Such that the current compensation module 50 can operate in a more stable manner. Also, the error amplifier 52 continuously and substantially compares the divided voltage VDS and the test resistor RT's cross voltage VRT for dynamically determining the compensation control signal CC and in turn for activating or deactivating the buffer switch SW. In this way, by appropriately setting the divided voltage VDS (e.g., by adjusting the resistor 5111 and 5112's resistances), the TRIAC dimmer circuit 20's operating current loop can be steadily controlled and maintained.

In some examples, the stabilizing system 100 additionally includes another voltage divider RS. The voltage divider RS's first terminal is electrically coupled to the TRIAC dimmer circuit 20 and the load conversion circuit 30. Also, the voltage divider RS's second terminal is electrically coupled to the AC power supply 10 and the second terminal of the test resistor RT. In addition, the voltage divider RS' voltage dividing terminal is electrically coupled to the first terminal of the phase detection module 40.

In some examples, the voltage divider RS has two resistors RS1 and RS2 connected in series. The resistors RS1 and RS2's intersection generates a corresponding divided voltage VRS that is then relayed to the phase detection module 40 for detecting the activating phase of the AC voltage.

As mentioned above, since the TRIAC dimmer circuit 20's operating current loop can be maintained and prevented from undesired current/power consumption, the illuminating unit 60 that is driven by the load conversion circuit 30 (via the drive power/operating current from the TRIAC dimmer circuit 20) will not have flickers in its luminance and can be efficient in its consumed current/power.

The invention claimed is:

1. A stabilizing system for a controllable dimmer, comprising:

an alternating current (AC) power supply, configured to provide an AC voltage;

a triode for alternating current (TRIAC) dimmer circuit, electrically coupled to the AC power supply, and configured to dynamically generate a drive power;

a load conversion circuit, electrically coupled to the TRIAC dimmer circuit, and configured to filter noises off the drive power and drive an external light emitting diode (LED) unit using the filtered drive power; and a current controller, electrically coupled to the AC power supply, the TRIAC dimmer circuit and the load conversion circuit, configured to detect an activating phase of the AC voltage from the drive power, during which the TRAIC dimmer circuit receives power from the AC power supply, and configured to keep a sum of a buffer current of the current controller and a load current of the load conversion circuit to approximate a predetermined critical current value and to exceed an operating current of the TRIAC dimmer circuit in response to the detected activating phase of the AC voltage;

wherein the TRIAC dimmer circuit is further configured to dynamically generate the drive power using the AC voltage and the operating current of the TRIAC dimmer circuit in response to the activating phase of the AC voltage.

2. The stabilizing system of claim 1, further comprising:

a rectifier, electrically coupled to the TRAIC dimmer circuit, and configured to rectify the drive power.

3. The stabilizing system of claim 2, wherein the rectifier is further configured to rectify the drive power via half-bridge rectification.

4. The stabilizing system of claim 2, wherein the rectifier is further configured to rectify the drive power via full-bridge rectification.

5. The stabilizing system of claim 1, wherein the TRAIC dimmer circuit comprises:

a variable resistor, having a first terminal electrically coupled to the AC power supply;

a constant resistor, having a first terminal electrically coupled to a second terminal of the variable resistor;

a diode for alternating current (DIAC) switch, having a first terminal electrically coupled to a second terminal of the constant resistor;

a capacitor, having a first terminal electrically coupled to a second terminal of the DIAC switch, and having a second terminal electrically coupled to the load conversion circuit; and a TRIAC element, having a trigger terminal electrically coupled to a switch terminal of the DIAC switch, having an input terminal electrically coupled to the AC power supply and the first terminal of the variable resistor, and having an output terminal electrically coupled to the load conversion circuit and a second terminal of the capacitor.

6. The stabilizing system of claim 5, wherein the DIAC switch is configured to trigger the TRIAC element when a cross voltage of the capacitor exceeds an activating threshold of the DIAC switch; and wherein the TRIAC element is configured to power up the load conversion circuit while being triggered by the DIAC switch.

7. The stabilizing system of claim 1, wherein the TRAIC dimmer circuit is implemented using a forward phase controller.

8. The stabilizing system of claim 1, wherein the TRAIC dimmer circuit is implemented using a reverse phase controller.

9. The stabilizing system of claim 1, wherein the current controller comprises:

a buffer current source, electrically coupled to the TRIAC dimmer circuit and the load conversion circuit;

a buffer switch, having a drain terminal electrically coupled to the buffer current source;

a test resistor, having a first terminal electrically coupled to the load conversion circuit, and having a second terminal electrically coupled to the AC power supply;

a phase detection module, having a first terminal electrically coupled to the TRAIC dimmer circuit, and having a second terminal electrically coupled to a control terminal of the buffer switch; and a current compensation module, having a sample terminal electrically coupled to the load conversion circuit and the first terminal of the test resistor, and having a compensation terminal electrically coupled to a control terminal of the buffer current source.

10. The stabilizing system of claim 9, wherein the phase detection module is configured to detect the activating phase of the AC voltage, and configured to activate the buffer switch in response to the activating phase of the AC voltage.

11. The stabilizing system of claim 9, wherein the current compensation module is configured to receive the load current from the load conversion circuit, and configured to generate a compensation control signal to the control terminal of the buffer current source for activating or deactivating the buffer current source in a manner that keeps the sum of the buffer current and the load current to approximate the predetermined critical current value and to exceed the operating current.

12. The stabilizing system of claim 11, wherein the current compensation module is further configured to render the compensation control signal to deactivate the buffer current source when the load current is larger than the predetermined critical current value.

13. The stabilizing system of claim 9, wherein the current compensation module comprises:

a voltage follower, having a first input terminal electrically coupled to an output terminal of the voltage follower;

an error amplifier, having a first input terminal electrically coupled to the output terminal of the voltage follower, having a second input terminal electrically coupled to the load conversion circuit and the first terminal of the test resistor, and having an output terminal electrically coupled to the control terminal of the buffer current source; and a voltage divider, having a voltage dividing terminal electrically coupled to a second input terminal of the voltage follower, having a ground terminal electrically coupled to ground, and having a power terminal electrically coupled to a direct-current (DC) voltage source.

14. The stabilizing system of claim 13, wherein the current compensation module further comprises:

a capacitor, having a first terminal electrically coupled to the first input terminal of the error amplifier, and having a second terminal electrically coupled to the ground terminal of the voltage divider.

15. The stabilizing system of claim 13, wherein the voltage divider is configured to generate a constant divided voltage that corresponds to the predetermined critical current value.

16. The stabilizing system of claim 9, further comprising:

a voltage divider, having a first terminal electrically coupled to the TRIAC dimmer circuit and the load conversion circuit, having a second terminal electrically coupled to the AC power supply and the second terminal of the test resistor, and having a voltage dividing terminal electrically coupled to the first terminal of the phase detection module.

17. A current controller for a controllable dimmer, comprising:

a buffer current source, configured to generate a buffer current in response to an external operating current of an TRIAC dimmer circuit;

a buffer switch, having a drain terminal electrically coupled to the buffer current source;

a test resistor, having a first terminal to receive a load current from an external load conversion circuit;

a phase detection module, electrically coupled to a control terminal of the buffer switch, configured to detect an activating phase of an external AC voltage that synchronizes with the TRIAC dimmer circuit, and configured to activate the buffer switch in response to the activating phase of the AC voltage; and a current compensation module, having a sample terminal electrically coupled to the first terminal of the test resistor, and having a compensation terminal electrically coupled to a control terminal of the buffer current source, wherein the current compensation module is configured to receive the load current, and configured to generate a compensation control signal to the control terminal the buffer current source for activating or deactivating the buffer current source in a manner that keeps the sum of the buffer current and the load current to approximate a predetermined critical current value and to exceed the operating current.

18. The stabilizing system of claim 17, wherein the current compensation module is further configured to render the compensation control signal to deactivate the buffer current source when the load current is larger than the predetermined critical current value.

19. The stabilizing system of claim 17, wherein the current compensation module comprises:

a voltage follower, having a first input terminal electrically coupled to an output terminal of the voltage follower;

an error amplifier, having a first input terminal electrically coupled to the output terminal of the voltage follower, having a second input terminal electrically coupled to the first terminal of the test resistor, and having an output terminal electrically coupled to the control terminal of the buffer current source; and a voltage divider, having a voltage dividing terminal electrically coupled to a second input terminal of the voltage follower, having a ground terminal electrically coupled to ground, and having a power terminal electrically coupled to a DC voltage source.

20. The stabilizing system of claim 19, wherein the current compensation module further comprises:

a capacitor, having a first terminal electrically coupled to the first input terminal of the error amplifier, and having a second terminal electrically coupled to the ground terminal of the voltage divider.

* * * * *